United States Patent [19]

Piegeau et al.

[11] Patent Number: 4,932,931

[45] Date of Patent: Jun. 12, 1990

[54] ATTACHMENT FOR BOX MAKING MACHINE

[76] Inventors: Roger R. Piegeau, 60 Cliftonvale Avenue, London, Ontario, Canada, N6J 1J8; Fred Schuster, 40 Hampton Crescent, London, Ontario, Canada, N6H 2N8

[21] Appl. No.: 263,056

[22] Filed: Oct. 27, 1988

[51] Int. Cl.[5] ..... B31B 1/54; B31B 1/58

[52] U.S. Cl. ..... 493/177; 493/181; 493/182; 493/183; 493/453; 198/816

[58] Field of Search ..... 493/163, 177, 181, 182, 493/183, 422, 453, 319; 198/816

[56] References Cited

U.S. PATENT DOCUMENTS

| | | | |
|---|---|---|---|
| 2,598,809 | 6/1952 | Liebl | 493/177 |
| 3,016,808 | 1/1962 | Galloway | 493/319 |
| 3,037,431 | 6/1962 | McGihon | 493/319 |
| 4,131,058 | 12/1978 | Graham | 493/182 |

*Primary Examiner*—Frederick R. Schmidt
*Assistant Examiner*—Jack W. Lavinder
*Attorney, Agent, or Firm*—St. Onge Steward Johnston & Reens

[57] ABSTRACT

In a folder gluer collapsable box making machine, a self-driven endless chain is mounted on sprockets on a small frame and is equipped with push plates and lifters such that when pre-cut box board moves along the conveyor of a box-making machine, the front of the pre-cut box board hits a pusher and moves the chain in a forward direction while the folder lifter arms abuts the rear portion of the box board and folds over the rear ends and/or flaps.

9 Claims, 6 Drawing Sheets

ATTACHMENT FOR BOX MAKING MACHINE

DESCRIPTION OF THE INVENTION

This invention relates to box making machines and in particular relates to an attachment for a straight line folder gluer machine used to make collapsible four corner boxes.

DESCRIPTION OF THE PRIOR ART

There are many box making machines on the market such as straight line, plunger type, and right angle machines. Pre-cut and creased box board enters the machine at one end, at the commencement of the production cycle, and is carried along on a conveyor. The machines contain various formers and folders and glues certain flaps as the box board proceeds along the conveyor.

One such machine a Babst-Media 68 Gluer*, which is used to make collapsible four cornered boxes. A collapsible box is a container made from box board cut and creased. When the blank is folded and glued into box shape, it is delivered in a flat or folded condition. When the body side walls are raised from horizontal to vertical position, the box is in a set-up condition. *
Trade mark The machine is equipped with diagonal formers for carrying out diagonal folds and front lifters for lifting such things as side panels or front end panels. The diagonal formers replace four corner converters in older machines. The box board proceeds along the machine on top of the conveyor and is pressed downwardly by a series of presses using ball bearings which by their weight, retain the box board in a flat condition unless a lifting or folding or forming operation is going on.

BACKGROUND OF THE INVENTION

As the box board proceeds along a flexible arm or lifter turns the front sides upward, then the sides are folded through formers or other front lifters. To fold up the rear sides and the flaps of the box, electronic timing devices with sensors are used. These rear folding attachments for a machine such as the Babst Media 68 Gluer* are extremely expensive and prone to problems as the timing and sensors often get out of adjustment and must be readjusted or changed for various sizes of boxes being made. *
Trade Mark The present invention eliminates the need for the very costly and expensive rear side folder mechanism by providing a very simple self-driven attachment which can be mounted on the machine.

In its simplest embodiment, the attachment comprises a self-driven endless chain mounted on sprockets. Push plates are mounted on the chain by couplings. On the opposite end of the push plate a folder lifter arm of spring steel is mounted. The sprockets are mounted on a frame and the frame is then mounted onto the machine.

In a commercial embodiment, three sprockets are used with an endless driving chain with three push plates and three lifting arms. The lifting arms point in the opposite direction to the push plate. The attachment or device is positioned on the machine such that as the box board progresses along the conveyor line, the front end of the box board strikes one of the push plates and moves the endless driving chain forwardly. As the box board progresses further, a lifter arm attached to another push plate swings around the front sprocket of the chain and in an upwards movement lifts and folds the rear side or flap of the box.

Usually two chains each equipped with push plates and folder lifter arms are mounted in parallel relationship to simultaneously use two lifters at one time to fold the rear side or two lifters to simultaneously fold a right and left rear flap.

In a more complex embodiment of the invention, a first chain mounted on sprockets is equipped with pushers and a second chain also mounted on sprockets is equipped with one or more folder lifter arms only. A connecting chain mounted on sprockets connects the first chain with the second chain. In this embodiment, the attachment is mounted above the conveyor and the folder lifter arm lifts and pulls forward the rear side or flap of the box into a folded position.

It is therefore an object of this invention to eliminate a complex and expensive electronically controlled and timed rear folder and to provide a simple attachment of low cost that requires no adjustment other than to accommodate varying box sizes.

SUMMARY OF THE INVENTION

Therefore, this invention seeks to provide a self-driven attachment for use with a folder gluer box making machine comprising: a frame; at least two sprockets mounted on said frame for rotation; an endless chain mounted on said sprockets; and at least three push plates and one folder lifter arm mounted on said chain; wherein in operation pre-cut box boards are moved forwardly on a conveyor and when each of said box boards abuts a push plate, said push plate moves said chain forwardly such that said lifter arm abuts the rear of said box board thereby folding a rear flap or side of said box board.

In a preferred embodiment, the invention seeks to provide a self-driven attachment for use with a folder gluer box making machine comprising; a frame mounted on said box making machine above a conveyor; a first endless chain with at least three push plates affixed thereon, said endless chain being mounted on four sprockets which are rotatably mounted on said frame; a second endless chain having at least one folder lifter arm affixed thereto, said second endless chain being mounted on a larger driving sprocket and a smaller driven sprocket; said sprockets free to rotate on their respective shafts, and said shafts being mounted to said frame; a connecting endless chain mounted on at least two sprockets one of said sprockets being mounted on a common shaft with a sprocket on which the first endless chain is mounted and a second sprocket mounted on a common shaft with said larger driving sprocket, said second sprocket being substantially smaller than said driving sprocket; wherein in operation, pre-cut box boards move forwardly on a conveyor and when each of said box boards abuts a push plate, said push plate moves said first chain forwardly thereby causing said connecting chain and said second chain to move forwardly, said second chain moving at a faster rate than said connecting chain; such that said folder lifter arm abuts the rear of said box board thereby folding the rear flap of said box board upwards.

In the simplest embodiment the chain rides on sprockets which are mounted on bearings. The sprockets mounted on bearings have nuts and bolts therethrough which attaches the sprockets and chain assembly to a small frame. The frame consists of a flat metal plate which has various slots in it for the sprockets to be mounted on. Depending upon the size of the box to be produced and the distance between the front of the box board and the rear fold, the length of the chain can be varied and the sprockets adjusted in the slots to accommodate a different chain length. In other words, the longer the distance between the front of the box which abuts the push plate and the rear of the box which has to be folded, the longer the chain that is used.

A chain guide is also necessary to keep the chain horizontal such that it does not allow the chain to sag or lower. It is mounted near the top of the frame to eliminate the front of the box board missing the push plate. In a preferred embodiment a first chain equipped with push plates, is connected to a connecting chain, which in turn, connects to a second chain which has one folder lifter arm. A large sprocket is used as the driving sprocket on the second chain. The large driving sprocket is on the same shaft as a smaller diameter sprocket on which the connecting chain is mounted. The whole assembly is mounted above the conveyor rather than below it as in the simplest embodiment. The second chain with the folder lifter arm moves approximately twice as fast as the first chain equipped with the pusher. In this manner, the second chain is adjusted so that the lifter arm very quickly flips up the rear flap as the box board passes by.

BRIEF DESCRIPTION OF THE DRAWINGS

The invention will be more fully described in conjunction with the following drawings wherein.

DETAILED DESCRIPTION OF THE DRAWINGS

Figure 1:
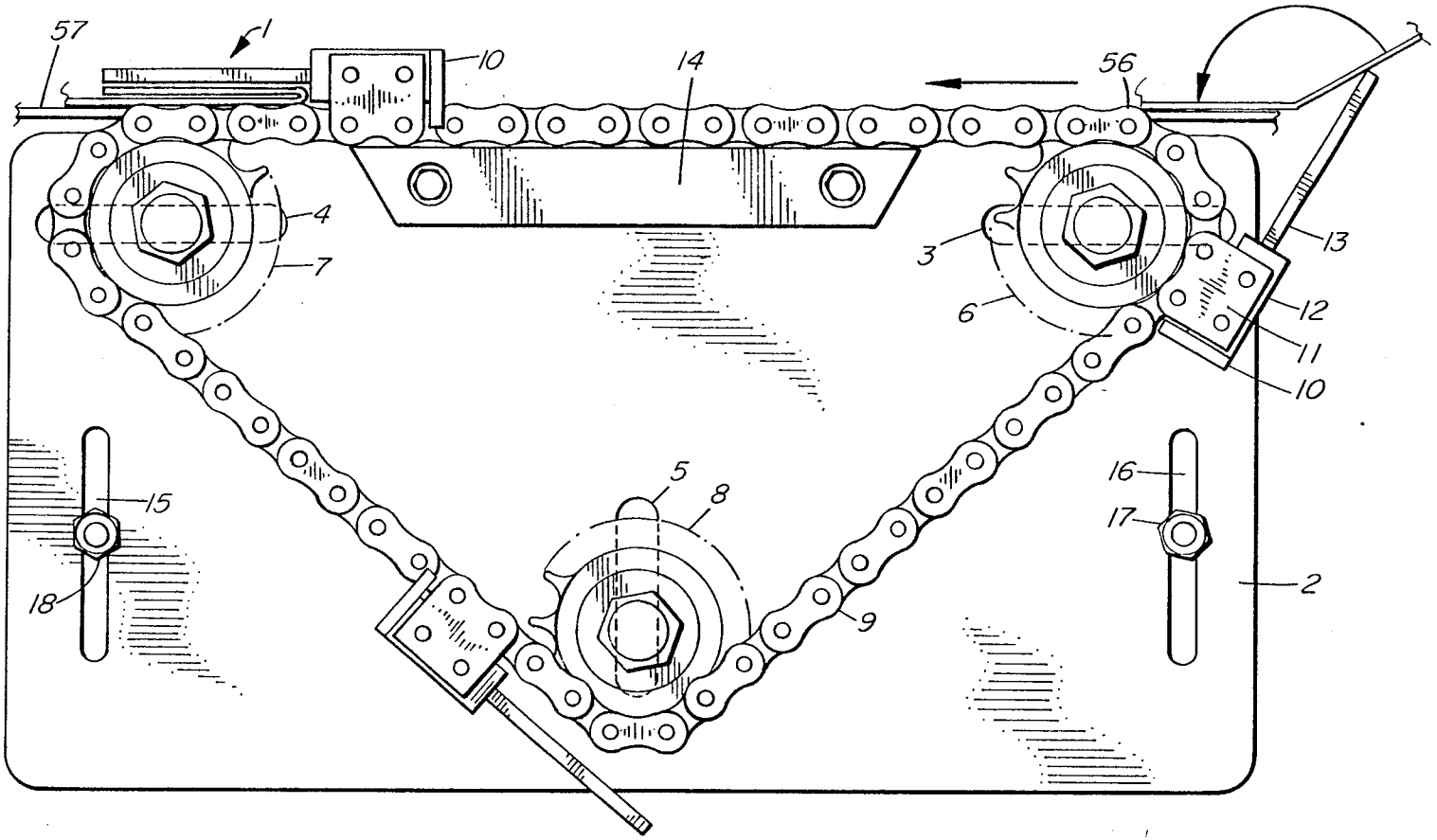
FIG. 1 is a side view of a first embodiment.

Turning to FIG. 1, the attachment for the folder gluer box making machine is shown as 1. It is mounted on a back plate 2 which is equipped with slots 3, 4 and 5. In the slots are mounted sprockets 6, 7 and 8. The sprockets are mounted on bearings for free rotation and are affixed to the slot by means of nuts and bolts (not shown). An endless driving chain 9 is mounted on the sprockets. Couplings 11 affix the body 12 of push plate 10 and folder lifter arm 13 to the chain.

The uppermost portion of the chain is kept horizontal and in line with the surface of the conveyor 54 by means of a chain guide 14. The chain guide is affixed to the frame by means of bolts (not shown). The frame of the attachment is affixed to the frame of the box making machines by bolts 17 and 18 mounted on slots 15 and 16. The direction of travel of the pre-cut box board is shown in FIG. 1 by means of an arrow, (i.e. moving from right to left in the drawing).

Figure 1A:
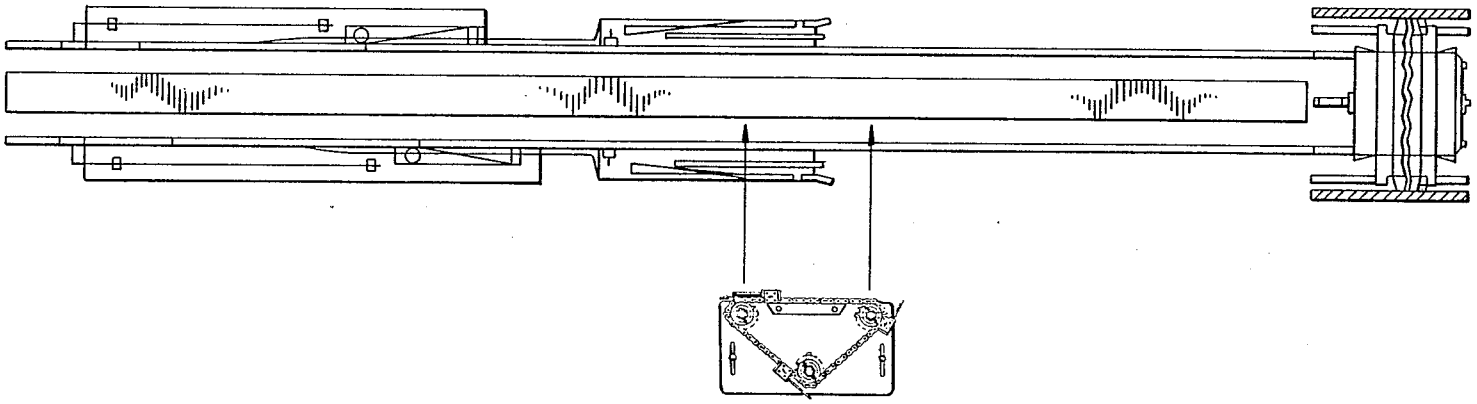
FIG. 1A is a top view of a prior art folder gluer box making machine showing the approximate positioning of the embodiment shown in FIG. 1

FIG. 1A is a top view of a box making machine. Arrows indicate where various folds form and gluing operations take place. The approximate placement of the embodiment shown in FIG. 1 is shown.

Figure 2:
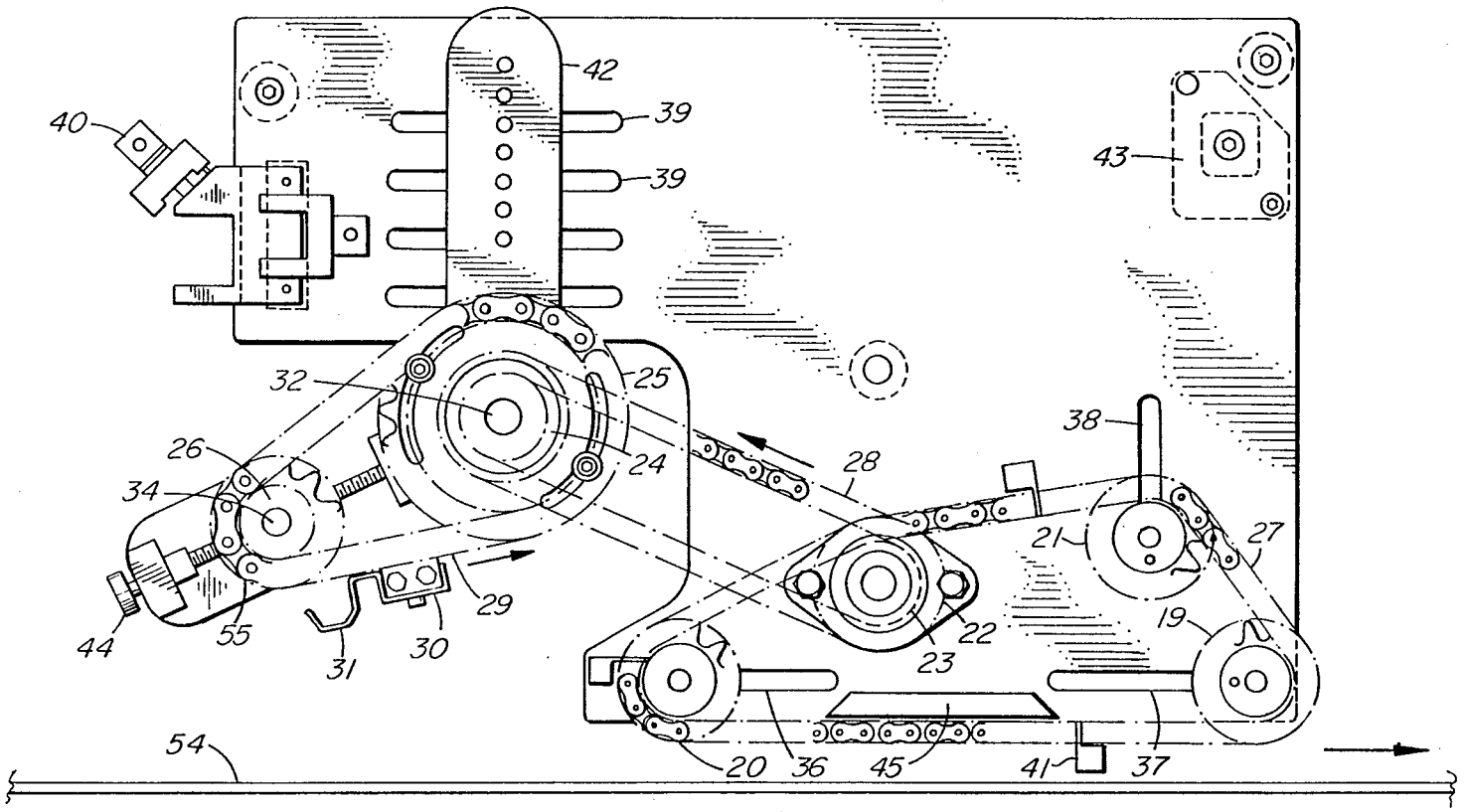
FIG. 2 is a side view of a more complex embodiment.
Figure 3:
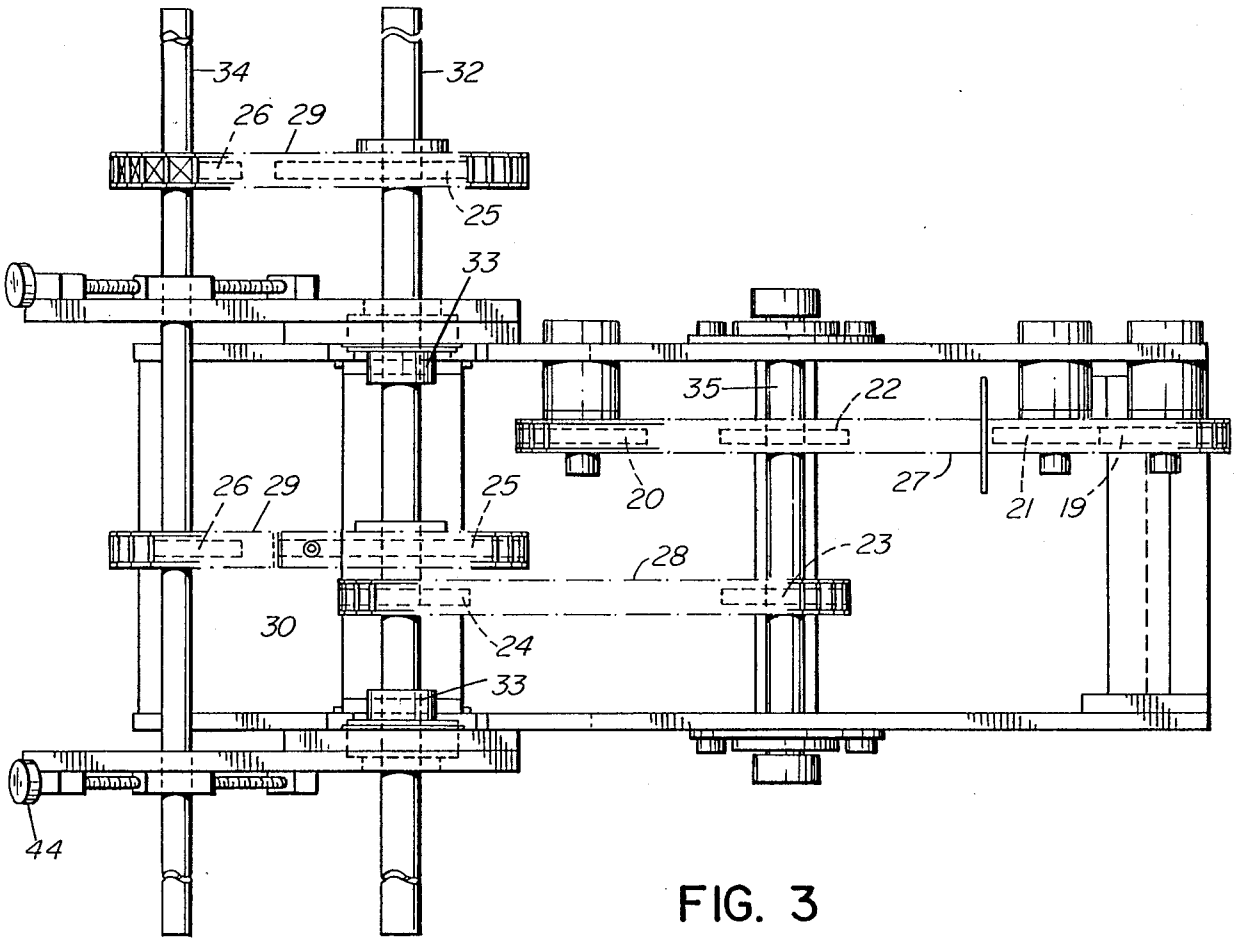
FIG. 3 is a top view of the embodiment shown in FIG. 2.

FIGS. 2 and 3 are a side view and a top view respectively of a second embodiment of the invention. A first endless chain known as a pusher chain 27 is mounted on sprockets 19, 20, 21, and 22. On the common shaft running through sprocket 22 is a second sprocket 23 known as a connector chain sprocket. A connector chain is mounted on connector chain sprocket 23 and a second connector chain sprocket 24. Second connector chain sprocket 24 is mounted on shaft 32 beside the larger driving sprocket 25. Mounted on driving sprocket 25 and second sprocket 26 is a folder lifter chain 29. Sprocket 26 is mounted on shaft 34. A folder lifter arm plate 30 is coupled to folder lifter chain 29. Attached to plate 30 is a semi-rigid folder lifter arm 31.

Shafts 32 and 34 turn within bearings 33. Sprockets 22 and 23 are mounted on shaft 35. Sprockets 19, 20 and 21 are adjustably mounted in slots 36, 37 and 38 respectively. Driving sprocket 25 can be adjusted vertically or laterally by moving and affixing it in one of adjustment slots 39. The driving wheel sprocket adjustment bracket is marked as 42. The rear shaft and sprocket adjustment 44 adjusts the distance between sprockets 25 and 26. A rear attachment means 40 and a front attachment means 43 are used to attach the frame of the attachment to the frame of the box making machine.

On pusher chain 27 are three pusher plates 41. A chain guide 45 maintains the lowermost portion of pusher plate chain 27 substantially horizontal in substantially the same plane as the box board moving on the conveyor. In FIG. 2 one sees that the attachment which is the subject of the invention is positioned above the conveyor 54 of the box making machine.

Figure 4:
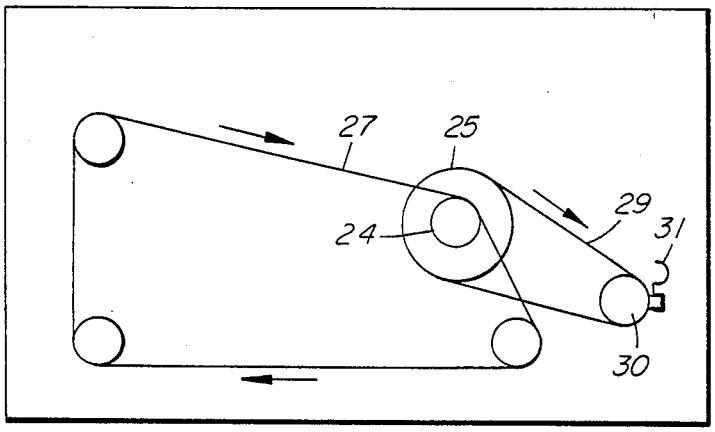
FIG. 4 is a third embodiment employing two chains without a connector chain.

In FIG. 4, an alternative embodiment of the invention is shown. Only pusher chain 27 and the folder lifter chain 29 mounted on their respective sprockets are used. The connecting chain 28 has been eliminated. The arrow indicates the direction of the box board. Again the large driving sprocket 25 is considerably larger than sprocket 24 with which it shares a common shaft.

Figure 5:
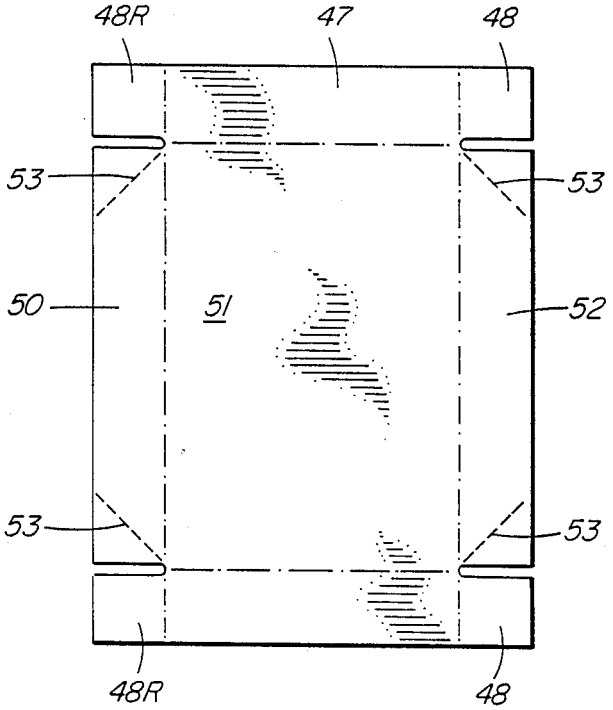
FIG. 5 is a top view of the box board cutout.

FIG. 5 illustrates a piece of box board that has been pre-cut and perforated along the folding creases. End panels 47 and 49, glue flaps 48, one side panel 50, a body 51 and another side panel 52 are shown. There are two diagonal creases 53 in each of the side panels 50 and 52.

Figure 6:
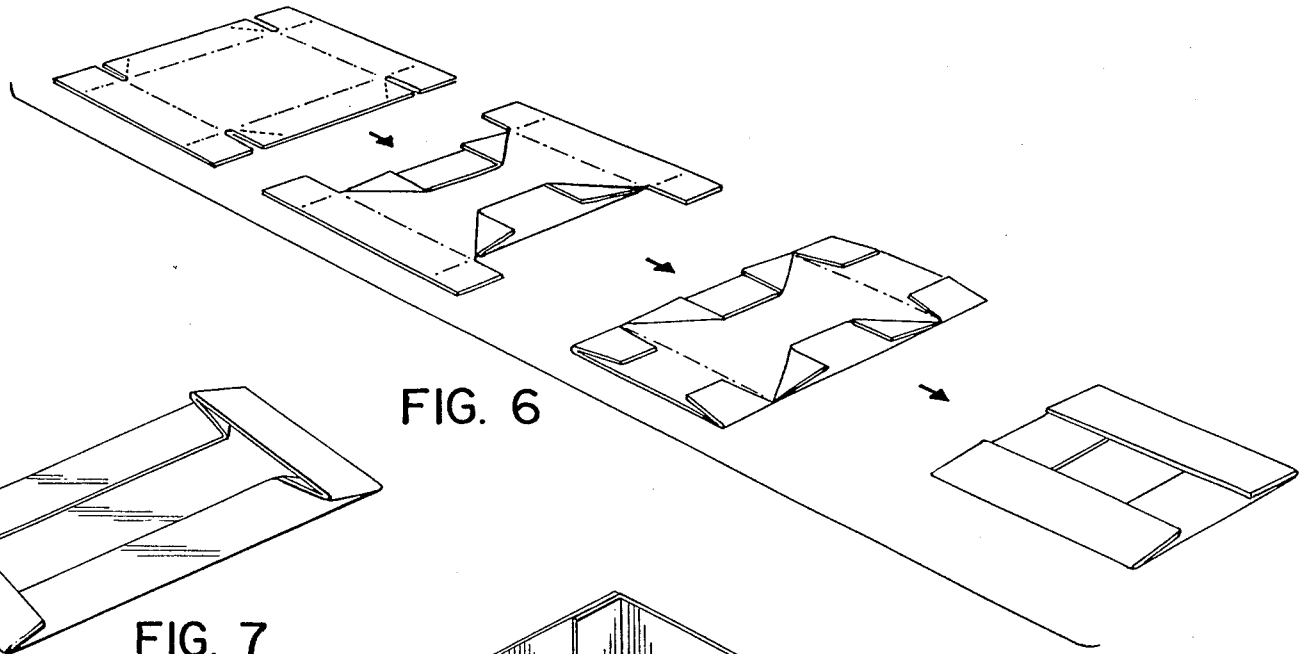
FIG. 6 shows the perspective view of the procedure for making a four corner box.

FIG. 6 illustrates the creation of a diagonal fold, a crosswise fold and a lengthwise fold in a folder gluer box making machine.

Figure 7:
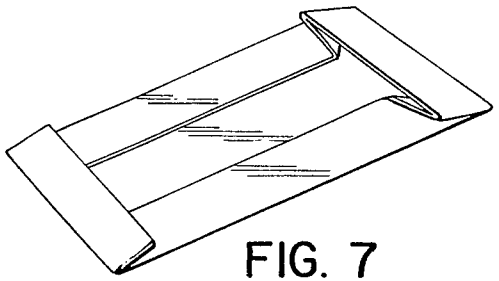
FIG. 7 is a perspective view of a collapsible box in the folded condition.
Figure 8:
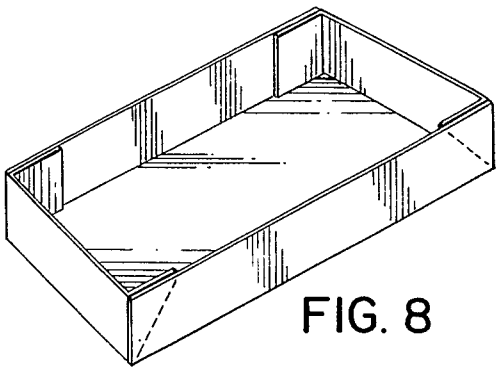
FIG. 8 is a perspective view of a collapsible box in an upright position.

FIG. 7 shows the finished product, a four cornered box in a collapsed stage and FIG. 8 illustrates a four cornered box ready to be filled with merchandise.

To show the operation of the invention, the embodiment shown in FIG. 2 will be used. A piece of pre-cut perforated box board moves (in the direction shown by an arrow) along conveyor table 54. When the box board strikes pusher block 41, chain 27 moves in a counter clockwise direction. Similarly, connector chain 28 moves in a counter clockwise direction as does folder lifter chain 29. The chain 29 moves much more rapidly than pusher chain 27 because of the difference in the sprocket diameter between sprocket 24 and sprocket 25. When folder lifter arm 31 on folder lifter plate 30 revolves around the chain to a point marked as 55 on sprocket 26, the semi-rigid folder lifter arm 31 catches the rear of the piece of box board and lifts the flap forwardly and upwardly since the box board is moving at a slower rate than the chain supporting the folder lifter arm.

One can see that by changing the size or position of the sprockets, the length of the pusher chain 27, or the distance between the pusher plates or the number of pusher plates, the predetermined distance between the front of the box board which abuts pusher block 41 and the rear of the box board where a fold is required, can be varied.

The operation of the invention in the embodiment in FIG. 1 is slightly different. The front of the box board moves along the conveyor surface 54 above the chain guide and abuts pusher plate 10. This causes the chain to revolve in a counter clockwise direction such that as the rear portion of the box board approaches a point marked 56 the semi-rigid folder lifter arm 13 pushes the rear end upwards and forwards thereby creating a fold in a side panel 50.

Examining FIG. 5, it is necessary to understand that in operation the pre-cut box board travels in the direction of the arrow shown in the drawing. The end panels are positioned at each side of the conveyor. Glue flaps 48R and side panel 50 are folded upwardly by the attachment which is the subject of this invention. By varying the number of the push plates 10 and the folder lifter arm 13 and varying the length of the chain 9 by adjusting sprockets 6, 7 and 8, the distance between side panel 50 and side panel 52 can thus be varied.

The major difference between the embodiment of the invention shown in FIG. 1 and those embodiments shown in FIGS. 2, 3 and 4 is the location of the frame of the attachment which is the subject of the invention. In FIG. 1, the frame 2 is mounted below the surface of the conveyor, and folder lifter arm 13 pushes side panel 58 and or glue flaps 48R upwardly and forwardly.

In the embodiment shown in FIGS. 2, 3 and 4, the frame is mounted above the conveyor and folder lifter arm 31 pulls the rear flap 50 and/or glue flaps 48R upwardly and forwardly from the top rather than pushing it upwardly and forwardly from the bottom.

In a commercial setting, the attachments shown in FIGS. 1, 2, and 3, or 4 are usually mounted in pairs and pusher plates and lifter folder arms work in pairs for larger folds, or when two rear flaps on opposite sides must be folded at once.

It is understood that the invention is not limited to the embodiments found herein, but is intended to include any variant which employs a chain, sprockets, pushers and folder lifter arms which is self-driven.

What we claim as our invention is:

1. A self-driven attachment for use with a folder gluer box making machine comprising: a frame mounted on said box making machine above a conveyor; a first endless chain with at least three means for driving affixed thereon, said endless chain being mounted on four sprockets which are rotatably mounted on said frame; a second endless chain having at least one lifter folder arm affixed thereto, said second endless chain being mounted on a larger driving sprocket and a smaller driven sprocket; said sprockets free to rotate on their respective shafts, said shafts being mounted to said frame; a connecting endless chain mounted on at least two sprockets, one of said sprockets being mounted on a common shaft with a sprocket on which the first endless chain is mounted and a second sprocket mounted on a common shaft with said larger driving sprocket, said second sprocket being substantially smaller than said driving sprocket; wherein, in operation, pre-cut box boards are moved forwardly on a conveyor and when each of said box boards abuts a means for driving, said means for driving moves said first chain forwardly, thereby causing said connecting chain and said second chain to move forwardly, said second chain moving at a faster rate than said connecting chain and said first chain; such that said lifter folder arm abuts the rear of said box board thereby folding the rear flap of said box board forwards and upwards.

2. An attachment as claimed in claim 1 wherein said means for driving includes a plate, a body, and a chain link coupling.

3. An attachment as claimed in claim 1 wherein said folder lifter arm includes a body, a coupling and a lifter plate, said plate being semi-rigid, rectangular and flat, and being bent at various angles and extending substantially rearwards of said body.

4. An attachment as claimed in claim 1 wherein three of said sprockets in said first endless chain are adjustably mounted on slots in said frame thereby accommodating chains of various lengths.

5. An attachment as claimed in claim 1 wherein said driven sprocket and said driving sprocket, on which said second endless chain is mounted, include bearings and are adjustable to accommodate various lengths of chain.

6. An attachment as claimed in claim 1 wherein a chain guide is mounted above the lowermost portion of said first endless chain such that the lowermost portion of said chain is substantially horizontal and lies in the same plane as said pre-cut box boards which travel along said conveyor of said box making machine.

7. An attachment as claimed in claim 1 including two second endless chains each having a folder lifter arm and each being mounted on a driving sprocket and driven sprocket respectively, wherein said two driving sprockets are mounted on a first common shaft and said two driven sprockets are mounted on a second common shaft such that in operation one or more sides or flaps of said box boards can be folded simultaneously by said folder lifter arms.

8. A self-driven attachment for use with a folder gluer box making machine comprising a frame mounted on said box making machine above a conveyor; a first endless chain with at least three means for driving affixed thereon, said endless chain being mounted on at least three sprockets, said sprockets being mounted for free rotation; a second endless chain having at least one folder lifter arm affixed thereto, said second endless chain being mounted on a larger driving sprocket and a smaller driven sprocket, said larger driving sprocket being mounted on a common shaft with one of said sprockets on which said first endless mounted; said driving sprocket having a substantially larger diameter than said sprocket on which said first endless chain is mounted wherein, in operation, pre-cut box boards are moved forwardly on a conveyor and when each of said box boards abuts a said means for driving, said means for driving moves said first chain forwardly thereby causing said second chain to move forwardly, said second chain moving at a faster rate, such that said folder lifter arm abuts the rear of the box board thereby folding the rear flap of the box board upwards.

9. An attachment as claimed in claim 8 wherein said first endless chain includes three means for driving; and also comprising a pair of second endless chains each including a lifter folder arm; each second endless chain being mounted on a driven sprocket and a driving sprocket, said second endless chains being disposed in parallel relationship, whereby in operation one or more flaps or sides are simultaneously lifted and folded by said folder lifter arms.

* * * * *

UNITED STATES PATENT AND TRADEMARK OFFICE

CERTIFICATE OF CORRECTION

PATENT NO. : 4,932,931

DATED : June 12, 1990

INVENTOR(S) : Roger R. Pigeau, et al.

It is certified that error appears in the above-identified patent and that said Letters Patent is hereby corrected as shown below:

On the title page, under item [19] and in item [76], the first inventor's last name "Piegeau" should be --Pigeau--.

Signed and Sealed this

Seventh Day of April, 1992

*Attest:*

HARRY F. MANBECK, JR.

*Attesting Officer*

*Commissioner of Patents and Trademarks*